US006876281B2

(12) United States Patent
Brown et al.

(10) Patent No.: US 6,876,281 B2
(45) **Date of Patent: *Apr. 5, 2005**

(54) VARIABLE TRANSMISSION LINE TRANSFORMER

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/659,189

(22) Filed: Sep. 10, 2003

(65) Prior Publication Data

US 2005/0052258 A1 Mar. 10, 2005

(51) Int. Cl.[7] ..... H03H 7/38
(52) U.S. Cl. ..... 333/263; 333/33; 333/35
(58) Field of Search ..... 333/32, 33, 35, 333/263

(56) References Cited

U.S. PATENT DOCUMENTS 5,162,972 A * 11/1992 Gripshover et al. ..... 361/277
6,496,082 B1 * 12/2002 DiPiazza ..... 333/101
6,515,235 B2 * 2/2003 Moller ..... 174/256

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Brown et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.

(Continued)

*Primary Examiner*—Stephen E. Jones
(74) *Attorney, Agent, or Firm*—Sacco & Associates, PA

(57) ABSTRACT

A transmission line transformer (102) having an electrical length and a fluid dielectric (108). A fluid control system (150) is also provided for selectively moving the fluid dielectric (108) from a first position to a second position. In the first position, the fluid dielectric (108) is electrically and magnetically coupled to the transmission line transformer (102) to produce a first impedance transformation. In the second position, the fluid dielectric is electrically and magnetically decoupled from the transmission line transformer (102) to produce a second impedance transformation distinct from the first impedance transformation. The fluid control system (150) can be responsive to a control signal (174) and can include a pump (154) for moving the fluid dielectric from the first position to the second position.

15 Claims, 3 Drawing Sheets

OTHER PUBLICATIONS

U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.

* cited by examiner

VARIABLE TRANSMISSION LINE TRANSFORMER

BACKGROUND OF THE INVENTION

1. Statement of the Technical Field

The inventive arrangements relate generally to transmission line transformers, and more particularly for transmission line transformers that can be dynamically tuned.

2. Description of the Related Art

RF circuits commonly utilize transmission lines manufactured on specially designed substrate boards. In an RF circuit, it is important to maintain careful control over impedance characteristics. If the impedance of different parts of the circuit do not match, inefficient power transfer, unnecessary heating of components, and other problems can result. A specific type of transmission line often used to match the impedances of different parts of the circuit is a transmission line transformer. Hence, the performance of transmission line transformers in printed circuits is often a critical design factor.

One common transmission line transformer is a quarter-wave transformer. As the name implies, a quarter-wave transformer typically has an electrical length precisely $\lambda/4$, where $\lambda$ is the signal wavelength in the circuit. Notably, transformers that have other lengths also can be used, but impedance calculations are simplified when the length of a transformer is an integer multiple of $\lambda/4$. In particular, the characteristic impedance of a properly tuned quarter-wave transformer is given by the formula $Z_0\sqrt{Z_1Z_3}$, where $Z_0$ is the desired characteristic impedance of the quarter-wave transformer, $Z_1$ is the impedance of an input transmission line to be matched, and $Z_2$ is the impedance of an output transmission line or load being matched to the input transmission line.

Printed transmission line transformers used in RF circuits can be formed in many different ways. One configuration known as microstrip, places the transmission line transformer on a board surface and provides a second conductive layer, commonly referred to as a ground plane. A second type of configuration known as buried microstrip is similar except that the transmission line transformer is covered with a dielectric substrate material. In a third configuration known as stripline, the transmission line transformer is sandwiched within substrate between two electrically conductive (ground) planes.

Low permittivity printed circuit board materials are ordinarily selected for implementing RF circuit designs, including transmission line transformers. For example, polytetrafluoroethylene (PTFE) based composites such as RT/duroid® 6002 (permittivity of 2.94; loss tangent of 0.009) and RT/duroid® 588 0(permittivity of 2.2; loss tangent of 0.0007), both available from Rogers Microwave Products, Advanced Circuit Materials Division, 100 S. Roosevelt Ave, Chandler, Ariz. 85226, are common board material choices.

Two important characteristics of dielectric materials are permittivity (sometimes called the relative permittivity or $\epsilon_r$) and permeability (sometimes referred to as relative permeability or $\mu_r$). The relative permittivity and permeability determine the propagation velocity of a signal, which is approximately inversely proportional to $\sqrt{\mu\epsilon}$. The propagation velocity directly affects the electrical length of a transmission line and therefore the physical length of a transmission line transformer.

Further, ignoring loss, the characteristic impedance of a transmission line, such as stripline or microstrip, is equal to $\sqrt{H_1/C_1}$, where $L_1$ is the inductance per unit length and $C_1$ is the capacitance per unit length. The values of $L_1$ and $C_1$ are generally determined by the permittivity and the permeability of the dielectric material(s) used to separate the transmission line structures as well as the physical geometry and spacing of the line structures. Accordingly, the overall geometry of a transmission line transformer will be highly dependent on the permittivity and permeability of the dielectric substrate.

The electrical characteristics of transmission line transformers generally cannot be modified once formed on an RF circuit board. This is not a problem where only a fixed operational frequency and a fixed characteristic impedance are needed since the geometry of the transmission line transformer can be readily designed and fabricated to achieve the proper design parameters. When a variable characteristic impedance is needed or the transmission line transformer must operate over a range of frequencies, however, use of a transmission line transformer having fixed dimensions can be a problem.

In particular, a transmission line transformer length optimized for a first RF frequency may provide inferior performance when used at other frequencies due to variations in electrical length. Moreover, if the transmission line transformer characteristic impedance is optimized for particular source and load impedances, the transmission line transformer may provide an inadequate impedance match if the source or load impedances should vary.

SUMMARY OF THE INVENTION

The present invention relates to a transformer apparatus that includes a transmission line transformer having an electrical length and a fluid dielectric. The electrical length of the transmission line transformer can be an integer multiple of approximately one-quarter of a signal wavelength at an anticipated operating frequency. In one arrangement, the fluid can be an industrial solvent. Further, the industrial solvent can have a suspension of magnetic particles contained therein.

A fluid control system is also provided for selectively moving the fluid dielectric from a first position to a second position. In the first position, the fluid dielectric is electrically and magnetically coupled to the transmission line transformer to produce a first impedance transformation. In the second position, the fluid dielectric is electrically and magnetically decoupled from the transmission line transformer to produce a second impedance transformation distinct from the first impedance transformation. For example, the permittivity and/or permeability of the fluid dielectric can be selected to provide a desired impedance transformation, or to change other electrical characteristics.

The fluid control system can be responsive to a control signal and can include a pump for moving the fluid dielectric from the first position to the second position. The first position can be defined by a bounded region located adjacent to the transmission line transformer and the second position can be defined by a fluid storage reservoir. The bounded region can be bounded by either a rigid conductive material or a rigid dielectric material.

DETAILED DESCRIPTION OF THE PREFERRED EMBODIMENTS

The present invention provides the circuit designer with an added level of flexibility by permitting a fluid dielectric to be used in an RF circuit, thereby enabling the dielectric properties proximate to a microstrip, a buried microstrip, and a stripline transmission line transformer (herein after collectively referred to as transmission line transformer) to be varied so that a particular transmission line transformer can be used over a broad frequency range and/or so that the transmission line transformer can be adjusted to match varying source and load impedances. Since propagation velocity is inversely proportional to $\sqrt{\mu\epsilon}$, increasing the permeability ($\mu$) and/or permittivity ($\epsilon$) in the dielectric decreases propagation velocity of a signal on a transmission line transformer coupled to the dielectric, and thus the signal wavelength. Further, the permittivity and/or permeability can be chosen to result in a desired characteristic impedance ($Z_0$) for the transmission line transformer as well. Accordingly, a transmission line transformer of a given size can be used over a broad range of frequencies and for different circuit impedances without altering the physical dimensions of the transmission line transformer.

Figure 1:
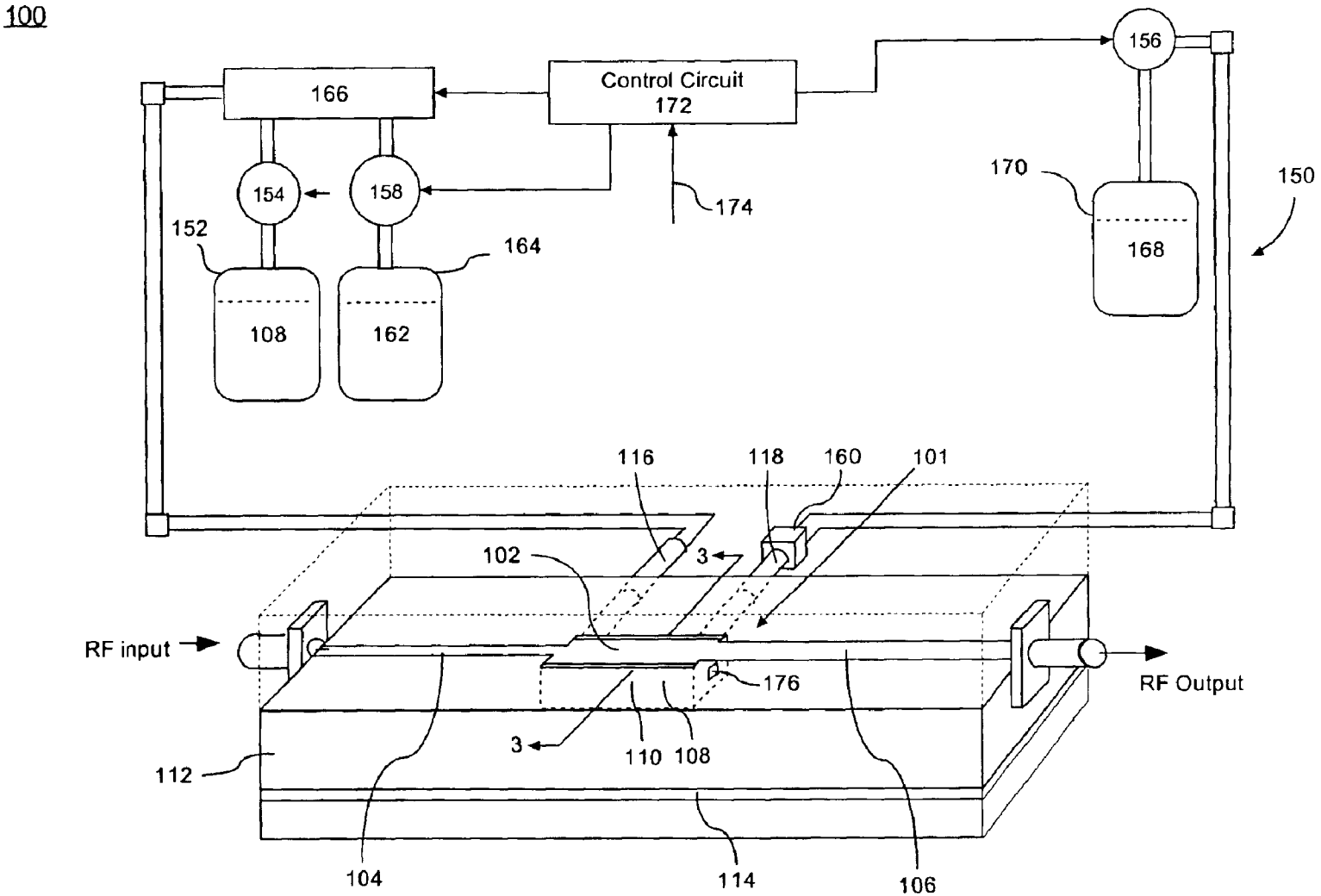
FIG. 1 is a conceptual diagram useful for understanding the variable transmission line transformer of the invention.

FIG. 1 is a conceptual diagram that is useful for understanding the variable transmission line transformer of the present invention. A transformer apparatus 100 includes a radio frequency circuit 101 comprising a transmission line transformer 102 having an electrical length. The transmission line transformer 102 is disposed between, and in electrical contact with, an input transmission line 104 and an output transmission line 106. In one arrangement, the transmission line transformer 102 can be in electrical contact with additional transmission lines. For example, the input transmission line 104 can provide a signal source to the transmission line transformer 102 and a plurality of transmission lines can be connected to the transmission line transformer 102 as loads.

Figure 2A:
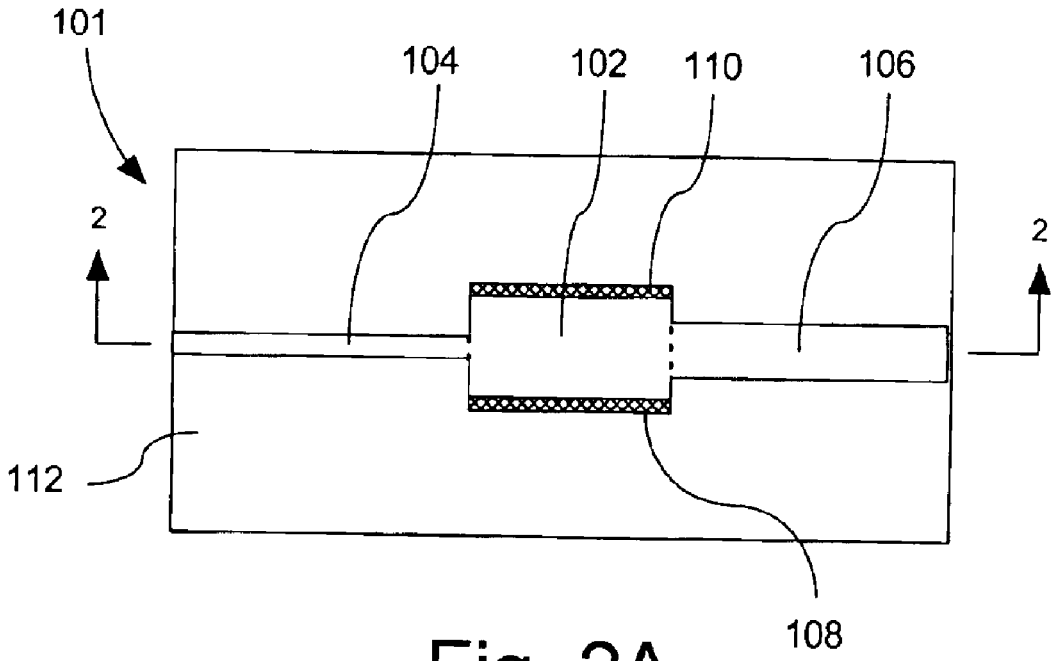
FIG. 2A is an enlarged view of the variable quarter wave transformer of FIG. 1.
Figure 2B:
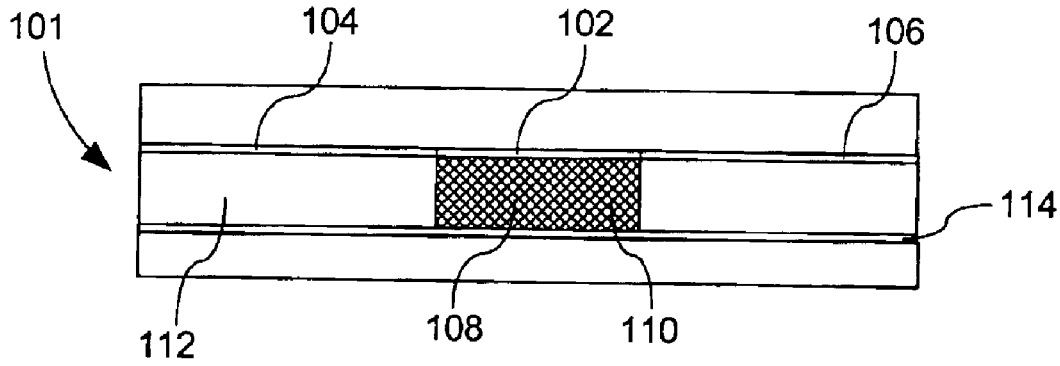
FIG. 2B is a section view of the variable quarter wave transformer of FIG. 2A taken along section line 2—2.

The transmission line transformer 102 is at least partially coupled to a fluid dielectric 108. The fluid dielectric 108 can be constrained within a cavity 110 that is generally positioned relative to the transmission line transformer 102 so as to be electrically and magnetically (electrically and magnetically) coupled thereto. An enlarged view of the quarter wave transformer 102 and transmission lines 104, 106 is shown in FIG. 2A. FIG. 2B shows a section view of the components of FIG. 2A taken along section line 2—2.

In operation, the transmission line transformer 102 can act as an impedance matching transformer between an input transmission line 104 and an output transmission line 106. For example, the transmission line transformer 102 can be a quarter-wave transformer. As noted, the proper characteristic impedance of a quarter-wave transformer is given by the formula $Z_0=\sqrt{Z_1Z_2}$, where $Z_0$ is the desired characteristic impedance of the quarter-wave transformer, $Z_1$ is the impedance of the input transmission line 104, and $Z_2$ is the impedance of the output transmission line 106. Importantly, the permeability and/or permittivity in the region defined by the cavity 110 can be varied to adjust the characteristic impedance of the transmission line transformer 102 at a given frequency. In particular, the ratio of permittivity to permeability can be adjusted while maintaining the product of the permittivity and permeability constant. Since the propagation velocity of a signal traveling on the transmission line, such as transmission line transformer 102, is proportional to $c/\sqrt{\mu_r\epsilon_r}$, maintaining the product of the permittivity and permeability constant maintains the operation frequency of the transmission line transformer 102 constant. Accordingly, the transmission line transformer 102 can be used to match a variety of circuit impedances while operating at a specific frequency. This can be a particularly useful feature if circuit source and/or load impedances vary, for example as load requirements change.

The characteristic impedance of a transmission line is not independent of the transmission line structure. However, it is always proportional to the square root of the ratio of the permeability to the permittivity of the media in which the conducting structures are embedded. Thus, for any transmission line, such as the transmission line transformer 102, if both the permeability and permittivity are changed in the same proportion, and no other changes are made, the propagation velocity of a signal on the transmission line will be varied while the characteristic impedance will remain constant. Hence, the operational frequency of the transmission line transformer 102 can be adjusted without negatively affecting the impedance matching performance of the transmission line transformer 102. This feature can be very particularly useful in communication circuits which operate on multiple frequencies. Nonetheless, the operational frequency and $Z_0$ of the transmission line transformer 102 also can be adjusted simultaneously, which is beneficial if both the operating frequency and load characteristics change simultaneously.

In the most basic form, the invention can be implemented using a single cavity 110 that can be approximately commensurate with the area beneath that portion of the circuit 101 where the transmission line transformer 102 is disposed. For example, the transmission line transformer 102 can be disposed on a dielectric substrate 112, above a cavity formed within the dielectric substrate 112 wherein the walls of the cavity form a region bounded by the dielectric substrate 112. However, the cavity structure is not so limited and other embodiments are also possible. For example, a cavity can be formed in a dielectric material, such as a plastic reservoir, which is sandwiched between the transmission line transformer 102 and the ground plane 114. In another arrangement, fluid capillaries can be provided between the transmission line transformer 102 and the ground plane 114.

Regardless of the particular structure selected for the fluid cavity 110, the fluid dielectric 108 can be injected into the fluid cavity 110 by means of a suitable fluid transfer conduit 116. A second fluid transfer conduit 118 can also be provided for permitting the fluid dielectric 108 to be purged from the fluid cavity 110. By selectively injecting the fluid dielectric 108 into the cavity 110, the permittivity and/or permeability of the region defined by the cavity 110 can be changed. In one arrangement, the cavity 110 can be completely filled with fluid dielectric 108. In another arrangement, the amount of fluid dielectric 108 within the cavity 110 can be adjustable to vary the permittivity and/or permeability within the cavity region.

The fluidic dielectric 108 can be injected into the cavity 110 to vary $Z_0$ of the transmission line transformer 102 or the propagation velocity of a signal on the transmission line transformer 102. Subsequently, by purging the fluid dielectric 108 from the cavity 110, the permittivity and permeability of the region defined by the cavity 110 again can be adjusted. For example, the permittivity and permeability become equal, or substantially equal, to the permittivity and permeability of a vacuum or some other gas or fluid which is used to displace the fluid dielectric 108. In one embodiment, the fluid dielectric 108 can be replaced with a second fluid dielectric having a different permittivity and/or permeability than the first fluid dielectric 108.

Figure 3A:
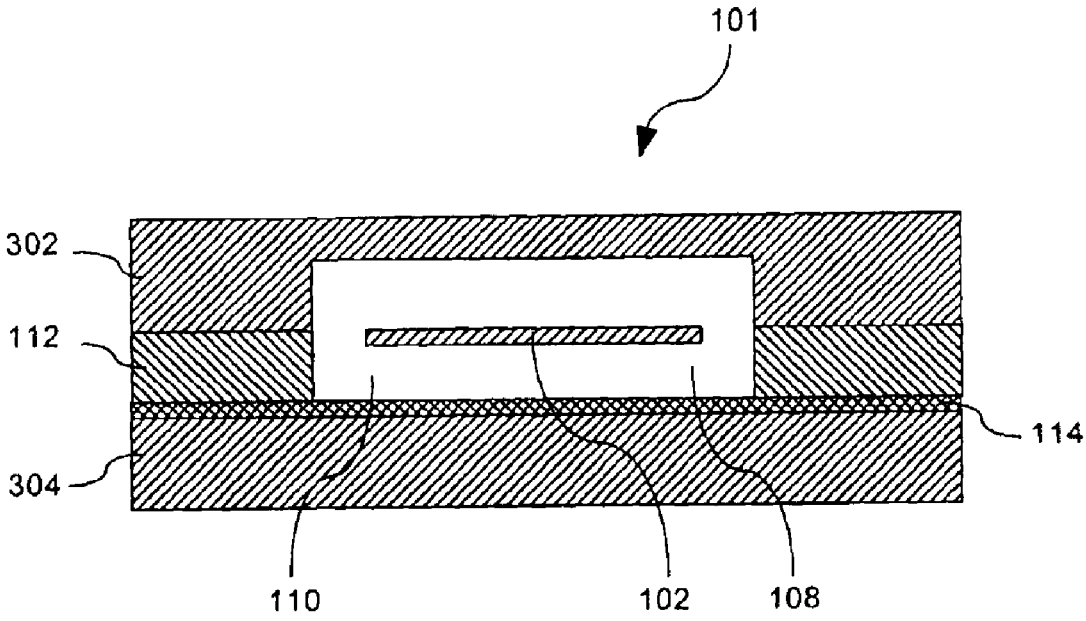
FIG. 3A is a cross-sectional view of the transmission line transformer structure in FIG. 1, taken along section line 3—3.

FIG. 3A is a cross-sectional view of one embodiment of the transmission line transformer in FIG. 1, taken along line 3—3, that is useful for understanding the invention. As illustrated therein, cavity 110 can be formed in substrate 112 and continued in cap substrate 302 so that the fluidic dielectric is closely coupled to transmission line transformer 102 on all sides of the transmission line transformer 102. The transmission line transformer 102 is suspended within the cavity 110 as shown. The ground plane 114 is disposed below the transmission line transformer 102 between substrate 112 and a base substrate 304.

According to one aspect of the invention, the solid dielectric substrate 112, 202, 304 can be formed from a ceramic material. For example, the solid dielectric substrate can be formed from a low temperature co-fired ceramic (LTCC). Processing and fabrication of RF circuits on LTCC is well known to those skilled in the art. LTCC is particularly well suited for the present application because of its compatibility and resistance to attack from a wide range of fluids. The material also has superior properties of wetability and absorption as compared to other types of solid dielectric material. These factors, plus LTCC's proven suitability for manufacturing miniaturized RF circuits, make it a natural choice for use in the present invention. Nonetheless, other dielectric substrates can be used and the invention is not so limited.

Figure 3B:
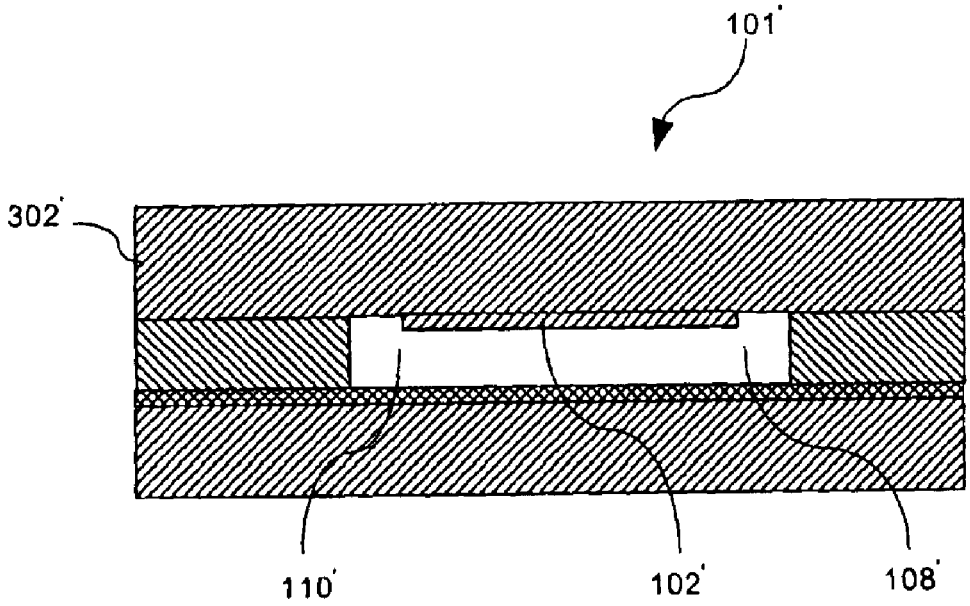
FIG. 3B is a cross-sectional view of an alternative embodiment of a transmission line transformer structure of FIG. 1.

FIG. 3B is a cross-sectional view showing an alternative arrangement for the transmission line transformer 102' in which the cavity structure 110' extends on only one side of the transmission line transformer 102' and the transmission line transformer 102' is partially coupled to the solid dielectric substrate 302'. In the case where the transmission line transformer is also partially coupled to a solid dielectric, the permeability $\mu_r$ necessary to keep the characteristic impedance of the line constant can be expressed as follows:

$$\mu_r = \mu_{r,sub}(\epsilon_r/\epsilon_{r,sub})$$

where $\mu_{r,sub}$ is the permeability of the solid dielectric substrate 102', $\epsilon_r$ is the permittivity of the fluidic dielectric 108' and $E_{r,sub}$ is the permittivity of the solid dielectric substrate 102'.

At this point it should be noted that while the embodiment of the invention in FIGS. 1–3 is shown essentially in the form of a buried microstrip construction, the invention herein is not intended to be so limited. Instead, the invention can be implemented using any type of transmission line by replacing at least a portion of a conventional solid dielectric material that is normally coupled to the transmission line with a fluidic dielectric as described herein. For example, and without limitation, the invention can be implemented in transmission line configurations including conventional waveguides, stripline, microstrip, coaxial lines, and embedded coplanar waveguides. All such structures are intended to be within the scope of the invention.

Fluid Control System

Referring once again to FIG. 1, it can be seen that the invention preferably includes a fluid control system 150 for selectively controlling the presence or removal of the fluid dielectric 108 from one or more cavities, such as cavity 110. The fluid control system can comprise any suitable arrangement of pumps, valves, conduits and controllers that is operable for effectively injecting and removing fluid dielectric 108, or any other fluid or gas, from the cavity 110 in response to a control signal. A wide variety of such fluid control systems may be implemented by those skilled in the art. For example, in one embodiment, the fluid control system can include a reservoir 152 for fluid dielectric 108 and a pump 154 for injecting the fluid dielectric into the cavity 110.

In one arrangement, the fluid control system 150 can incorporate a sensor 176 which monitors fluid levels in the cavity 110. Accordingly, the fluid control system can adjust fluid dielectric 108 levels within the cavity 110 to vary the permittivity and/or permeability in the cavity region. Predetermined permittivity and/or permeability values correlating to various fluid levels can be predetermined for use by the controller in establishing proper fluid levels.

When it is desired to purge the fluid dielectric from the cavity 110, a pump 156 can be used to draw the fluid dielectric from the cavity 110. A control valve 160 can be provided to allow the fluid dielectric to be purged from the cavity 110 as needed. Alternatively, in order to ensure a more complete removal of all fluid dielectric from the cavity 110, one or more pumps 158 can be used to inject a dielectric solvent 162 into the cavity 110. The dielectric solvent 162 can be stored in a second reservoir 164 and can be useful for ensuring that the fluid dielectric is completely and efficiently flushed from the cavity 110. A control valve 166 can be used to selectively control the flow of fluid dielectric 108 and dielectric solvent 162 into the cavity 110. A mixture 168 of the fluid dielectric 108 and any excess dielectric solvent 162 that has been purged from the cavity 110 can be collected in a recovery reservoir 170. For convenience, additional fluid processing, not shown, can also be provided for separating dielectric solvent from the fluid dielectric contained in the recovery reservoir for subsequent reuse. However, the additional fluid processing is a matter of convenience and not essential to the operation of the invention.

A control circuit 172 can control the operation of the various valves 160, 166 and pumps 154, 156, 158 necessary to inject and purge the fluid dielectric and/or dielectric solvent from the cavity 110. The control circuit 172 can be responsive to an analog or digital control signal 174 for selectively controlling the presence and removal of the fluid dielectric and the dielectric solvent from the cavity 110. It should be understood that the fluid control system 150 is merely one possible implementation among many that could be used to inject and purge fluid dielectric from the cavity 110 and the invention is not intended to be limited to any particular type of fluid control system. All that is required of the fluid control system is the ability to effectively control the presence and removal of the fluid dielectric 108 from the cavity 110.

Composition of Fluid Dielectric

The invention is not limited to any particular fluid dielectric or dielectric solvent. Many applications require variable transmission line transformers to be tunable over a wide frequency range. Accordingly, it may be desirable in many instances to select a fluid dielectric that has a relatively constant response over a broad range of frequencies. Moreover, for broadband applications, the fluids should not have significant resonances over the frequency band of interest. Further, fluid viscosity is a consideration. A fluid dielectric having a lower fluid viscosity may be easier to inject in to the fluid cavity and purge from the fluid cavity. Aside from the foregoing considerations, there are relatively few limits on the type of fluid dielectric that can be used.

Accordingly, those skilled in the art will recognize that the examples of fluid dielectric as shall be disclosed herein are merely by way of example and are not intended to limit in any way the scope of the invention. A nominal value of permittivity ($\epsilon_r$) for certain exemplary fluids is approximately 2.0. However, the present invention can include fluids having extreme values of permittivity. For example, fluids could be selected with permittivity values ranging from approximately 2.0 to about 58. Typical fluid dielectrics can include oil, such as Vacuum Pump Oil MSDS-12602, which have low permittivity and low permeability, and/or solvents, such as such as formamide, which has high permittivity and low permeability. Accordingly, high permittivity can be achieved by incorporating solvents such as formamide into the fluid dielectric. Fluid permittivity also can be increased by adding high permittivity dielectric particle suspensions, for instance powders such as Barium Titanate manufactured by Ferro Corporation of Cleveland, Ohio.

The fluid dielectric also can be provided with a variety of levels of magnetic permeability ($\mu_r$). High permeability can be achieved in a fluid by introducing metal particles/elements to the fluid. For example, magnetic metals such as Fe and Co which have high levels of magnetic permeability can be incorporated into the fluid dielectric. Notably, some solid alloys of these materials can exhibit levels of ($\mu_r$) in excess of one thousand. It should be noted that fluids containing electrically conductive magnetic particles require a mix ratio low enough to ensure that no electrical path can be created in the mixture.

Other fluids comprise suspensions of ferro-magnetic particles, for example those commercially available from FerroTec Corporation of Nashua, N.H. 03060, in a conventional industrial solvent such as water, toluene, mineral oil, silicone, and so on. Magnetic particles such as metallic salts, organo-metallic compounds, and other derivatives also can be used in the fluid. Further, certain ferrofluids also can be used to introduce a high loss tangent into the fluid dielectric. The size of the magnetic particles found in such systems is known to vary to some extent. However, particles sizes in the range of 1 nm to 20 $\mu$m are common. The composition of particles can be selected as necessary to achieve the required permeability in the fluid dielectric. However, magnetic fluid compositions are typically between about 50% to 90% particles by weight. Increasing the number of particles will generally increase the permeability.

Importantly, any variety of permittivity and permeability ratios can be achieved by incorporating fluids having combinations of the above mentioned fluids and particles. For example, an oil having a suspension of ferro-magnetic particles can be used as a low permittivity, high permeability fluid. A solvent having a suspension of dielectric and ferro-magnetic particles can be used as a high permittivity, high permeability fluid. Still, many other fluid or fluid/particle combinations can be used. Additional ingredients such as surfactants can be included to promote uniform dispersion of the particles.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A transformer apparatus, comprising:

a transmission line transformer having an electrical length;

a fluid dielectric; and a fluid control system for selectively moving said fluid dielectric from a first position, where said fluid dielectric is electrically and magnetically coupled to said transmission line transformer to produce a first impedance transformation, to a second position, thereby producing a second impedance transformation distinct from said first impedance transformation.

2. The transformer apparatus according to claim 1 wherein said electrical length is approximately equal to an integer multiple of a one-quarter wavelength at a design operating frequency.

3. The transformer apparatus according to claim 1 wherein at least one electrical characteristic of said transmission line transformer is changed when said fluid dielectric is moved from said first position to said second position.

4. The transformer apparatus according to claim 3 wherein said electrical characteristic is a characteristic impedance of said transmission line transformer.

5. The transformer apparatus according to claim 1 wherein said fluid control system includes a pump for moving said fluid dielectric between said first position and said second position.

6. The transformer apparatus according to claim 5 wherein said first position is defined by a bounded region located adjacent to said transmission line transformer and said second position is defined by a fluid storage reservoir.

7. The transformer apparatus according to claim 6 wherein said bounded region is bounded by at least one of a solid conductive material and a solid dielectric material.

8. The transformer apparatus according to claim 1 wherein said fluid control system is responsive to a control signal for selectively moving said fluid dielectric between said first and second position.

9. The transformer apparatus according to claim 1 wherein said fluid dielectric is comprised of an industrial solvent.

10. The transformer apparatus according to claim 9 wherein said industrial solvent has a suspension of magnetic particles contained therein.

11. A method for dynamically controlling an impedance transformation characteristic of a transmission line transformer, comprising the steps of:

transforming a first impedance connected at a first end of said transmission line transformer to a second impedance at a second end of said transmission line transformer; and responsive to a control signal, transforming said first impedance to a third impedance at said second end of said transmission line transformer by moving a fluid dielectric from a first position, where said fluid dielectric is electrically and magnetically coupled to said transmission line transformer, to a second position.

12. The method according to claim 11 further comprising the step of selecting a permittivity and a permeability of said fluid dielectric to provide a desired impedance transformation when said fluid dielectric is moved from said first position to said second position.

13. The method according to claim 11 further comprising the step of selecting said transmission line transformer to have an electrical length equal to an integer multiple of about one-quarter wavelength at a design operating frequency.

14. The method according to claim 11 further comprising the step of operating a pump to move said fluid dielectric from said first position to said second position.

15. The method according to claim 12 further comprising the step of selecting said first position to be a bounded region located adjacent to said transmission line transformer and selecting said second position to be a fluid storage reservoir spaced apart from said transmission line transformer.

* * * * *

UNITED STATES PATENT AND TRADEMARK OFFICE

CERTIFICATE OF CORRECTION

PATENT NO. : 6,876,281 B2
APPLICATION NO. : 10/659189
DATED : April 5, 2005
INVENTOR(S) : Brown et al.

It is certified that error appears in the above-identified patent and that said Letters Patent is hereby corrected as shown below:

Column 1

Line 31, delete " $Z_0\sqrt{Z_1Z_3}$ " and replace with -- $Z_0 = \sqrt{Z_1Z_2}$ --

Column 2

Line 3, delete " $\sqrt{H_1/C_1}$ " and replace with -- $\sqrt{L_1/C_1}$ --

Signed and Sealed this

Twenty-ninth Day of August, 2006

JON W. DUDAS
*Director of the United States Patent and Trademark Office*